US008721218B2

(12) United States Patent
Stenzel

(10) Patent No.: US 8,721,218 B2
(45) Date of Patent: May 13, 2014

(54) VIBRATING PLATE WITH UNBALANCED SHAFTS ARRANGED AT AN ANGLE

(75) Inventor: Otto W. Stenzel, Herrsching (DE)

(73) Assignee: Wacker Neuson Produktion GmbH & Co. KG, Munich (DE)

( * ) Notice: Subject to any disclaimer, the term of this patent is extended or adjusted under 35 U.S.C. 154(b) by 1234 days.

(21) Appl. No.: 11/993,131

(22) PCT Filed: Jun. 23, 2006

(86) PCT No.: PCT/EP2006/006087
§ 371 (c)(1),
(2), (4) Date: Apr. 19, 2010

(87) PCT Pub. No.: WO2006/136446
PCT Pub. Date: Dec. 28, 2006

(65) Prior Publication Data

US 2010/0199774 A1 Aug. 12, 2010

(30) Foreign Application Priority Data

Jun. 24, 2005 (GB) ..... 10 2005 029 433

(51) Int. Cl.
*E01C 19/30* (2006.01)

(52) U.S. Cl.
USPC ..... 404/133.05

(58) Field of Classification Search
USPC ..... 366/108; 404/133.1, 133.05, 84.1
See application file for complete search history.

(56) References Cited

U.S. PATENT DOCUMENTS

| | | | | |
|---|---|---|---|---|
| 3,972,637 | A * | 8/1976 | Sutherland | 404/133.1 |
| 4,356,736 | A * | 11/1982 | Riedl | 74/61 |
| 4,784,206 | A | 11/1988 | Sauerman | |
| 5,355,732 | A | 10/1994 | Anderl | |
| 5,410,879 | A * | 5/1995 | Houze | 60/469 |
| 7,354,221 | B2 * | 4/2008 | Congdon | 404/84.1 |
| 2004/0022582 | A1 * | 2/2004 | Sick | 404/133.05 |

FOREIGN PATENT DOCUMENTS

| | | | |
|---|---|---|---|
| FR | 2625117 | A1 | 6/1989 |
| GB | 1166025 | A | 10/1969 |

OTHER PUBLICATIONS

WO 2005/093160 to Sick et al. published Oct. 6, 2005.*

* cited by examiner

*Primary Examiner* — Tony G Soohoo
*Assistant Examiner* — Anshu Bhatia
(74) *Attorney, Agent, or Firm* — Boyle Fredrickson, S.C.

(57) ABSTRACT

A vibrating plate for compacting soil comprises an upper mass; a lower mass, which is elastically coupled to the upper mass and which has at least one soil contact plate, and; a vibration generator device that acts upon the soil contact plate. The vibration generator device comprises at least four unbalanced masses that can each be rotationally driven about a rotation axis, the rotation axis of at least two of the unbalanced masses being arranged at an angle to the rotation axes of the other unbalanced masses. One of the unbalanced masses depicts a reference unbalanced mass that does not require its own phase adjusting device. On the other hand, a separate phase adjusting device is assigned to each of the other unbalanced masses, enabling the phase position of these unbalanced masses to be individually adjusted with regard to the reference unbalanced mass.

17 Claims, 7 Drawing Sheets

VIBRATING PLATE WITH UNBALANCED SHAFTS ARRANGED AT AN ANGLE

BACKGROUND OF THE INVENTION

1. Field of the Invention

The present invention relates to a vibrating plate according to the preamble of patent claim 1.

2. Description of the Related Art

Vibrating plates for soil compaction are known, and are made up in principle of a lower mass having a soil contact plate and an upper mass that is coupled to the lower mass by springs so as to be capable of motion, and that has a drive (e.g. an internal combustion engine or electric motor). The drive drives a vibration exciter device that appertains to the lower mass and that charges the soil contact plate.

The vibration exciter device introduces a directed vibration into the soil contact plate. The vibrating soil contact plate acts on the soil in order to compact it. In addition, the resultant overall force produced by the vibration exciter device can achieve propulsion in the longitudinal direction, as well as a steering of the vibrating plate. Because the principle of this design has long been known, more detailed description is not necessary here.

As a vibration exciter device, what is known as a one-shaft exciter, or plate compactor, is known, in which the drive rotationally drives an imbalance shaft that bears an imbalance mass. During its rotation, the imbalance shaft lifts the soil contact plate upward and forward in order to achieve forward motion. Subsequently, the soil contact plate is pressed downward by the action of the imbalance shaft, and strikes the soil that is to be compacted.

In larger vibrating plates, the vibration exciter device has two or three imbalance shafts that are coupled to one another mechanically, or with a positive fit, and that are situated parallel to one another. In a two-shaft exciter, such as that known for example from EP 0 358 744 A1, two imbalance shafts, each bearing an imbalance mass, are positively coupled to one another and are situated so as to be capable of rotation in opposite directions. The phase position of the imbalance
shafts relative to one another, it is possible to modify the direction of a resultant force vector, causing a change in the propulsion behavior. In particular, in this way it is possible to achieve forward and backward travel of the vibrating plate.

In a further development, the imbalance mass on one of the imbalance shafts is divided into two or more partial imbalance masses that can be adjusted relative to one another. If the partial imbalance masses on the imbalance shaft are adjusted asymmetrically to one another, a yaw moment can be produced around the vertical axis of the vibration exciter device, permitting steering of the vibrating plate. In the case of a symmetrical adjustment, in particular if, as in EP 0 358 744 A1, partial imbalance masses are fixedly attached to the relevant imbalance shaft and other partial imbalance masses are capable of being moved relative thereto, the resultant imbalance action can be adjusted, enabling setting of the resultant imbalance forces.

Standardly, in known vibration exciter devices the imbalance shafts are situated parallel to one another. In modern vibrating plates, it is therefore possible to achieve forward and backward travel, as well as to cause the vibrating plate to rotate in place or to travel on a curve. However, for some applications the user will desire a lateral movement of the vibrating plate, in order for example to enable travel behind lateral projections. When compacting soil on laterally inclined surfaces, the vibrating plate often drifts obliquely downward, so that the operator must orient the vibration plate obliquely in order to compensate this. However, in this case the soil at the upper and lower edge is compacted only by a corner of the soil contact plate, resulting in unsatisfactory compaction.

In these cases of application, it would be helpful for the vibrating plate to be capable of executing a lateral movement. However, in order to achieve such a lateral movement, the vibration exciter device would have to achieve a corresponding force action in the lateral direction.

From GB 1 166 025 A, another vibrating plate is known in which a vibration exciter device has four imbalance masses that are each capable of being driven rotationally about an axis of rotation.

From DE 100 53 446 A1, a vibrating plate is known that has an upper mass and a lower mass comprising a soil contact plate. The soil contact plate is charged by a vibration exciter device having two vibration exciters. Each of the vibration exciters is made up of two shafts, situated parallel to one another, that are positively coupled to one another and that rotate in opposite directions, each bearing an imbalance mass, and being situated so that their phase positions relative to one another can be adjusted. In contrast, the phase position of shafts of different vibration exciters is not adjustable.

OBJECT OF THE INVENTION

The underlying object of the present invention is to indicate a vibrating plate that is capable of movement with three degrees of freedom, i.e. in the longitudinal direction (main direction of travel), in the lateral direction, and rotationally about the vertical axis, with, simultaneously, a minimum number of imbalance shafts.

According to the present invention, this object is achieved by a vibrating plate according to patent claim 1. Advantageous further developments of the present invention are indicated in the dependent patent claims.

A vibrating plate according to the present invention has an upper mass, usually including a drive, a lower mass that is elastically coupled to the upper mass and that has at least one soil contact plate, and a vibration exciter device that charges the soil contact plate. The vibration exciter device has at least four imbalance masses that can each be rotationally driven about an axis of rotation, the axes of rotation of at least two of the imbalance masses standing at angles to the axes of rotation of the other imbalance masses.

The imbalance masses are each standardly borne by a respective imbalance shaft, so that the axis of rotation of an imbalance mass is also simultaneously the axis of rotation of the imbalance shaft that bears it. A situation of the axes of rotation "at an angle" is to be understood as a situation that is not parallel or coaxial. Whereas up to now the axes of rotation of the imbalance masses have standardly been situated parallel to one another, according to the present invention a situation at an angle of at least two of the imbalance masses is now proposed. The situation at an angle of the axes of rotation on the soil contact plate has the result that the imbalance masses not only produce force actions in the longitudinal direction (main direction of travel of the vibrating plate), but also produce force components in the lateral direction. Given a suitable controlling of the rotation of the imbalance masses, it is therefore possible to produce a lateral movement of the vibrating plate. In addition, it continues to be possible also to produce a yaw moment about the vertical axis of the vibrating plate in order to steer the vibrating plate.

Through the rotation of the imbalance shafts, the imbalance masses situated thereon each produce a centrifugal force vector that rotates in a plane that is perpendicular to the axis of rotation of the imbalance shaft. If the axes of rotation of the imbalance shafts are situated at an angle to one another on the soil contact plate, the force vectors of the imbalance masses correspondingly also act in different planes. Depending on the controlling of the imbalance shafts, force actions in various directions can be produced that bring about a corresponding movement of the soil contact plate.

Of course, imbalance masses can also be provided whose axes of rotation are situated coaxially or parallel to one another. Thus, various mixed arrangements are conceivable in order to achieve a desired travel, directional, and compaction behavior of the vibrating plate.

In addition, it is possible to provide imbalance masses having different masses. Such a specific embodiment takes into account for example the recognition that in the majority of cases the vibrating plate is used in forward and backward travel operation, while rotation, as well as curved and oblique travel, are the exception, or require smaller forces. Correspondingly, the imbalance masses used for forward and backward travel should have larger masses than do the imbalance masses that are intended to bring about only curved or lateral travel.

The lower mass can also be fashioned so as to have a plurality of soil contact plates that are charged by the vibration exciter device. In this way, the vibrating plate has the possibility of adapting to uneven terrain. In addition, individual soil contact plates can be used for the forward movement or steering of the vibrating plate as a whole, while other soil contact plates are used solely for soil compaction.

It is particularly advantageous if the axes of rotation of the imbalance masses also do not stand at an angle of 90° to one another, so that the term "at an angle" refers to angles between 0° and 90°, or between 90° and 180° ($0 \leq \alpha \leq 90$; $90 \leq \alpha \leq 180$). The axes of rotation of the imbalance masses are then situated obliquely to one another in such a way that at least some of the imbalance masses produce force components both in the forward direction (main travel direction X) and in the lateral direction.

Advantageously, a phase adjustment device is allocated to each of at least some of the imbalance masses, in order to enable adjustment of the phase position of the allocated imbalance mass relative to the phase positions of the other imbalance masses. Through adjustment of the phase positions, the direction and the magnitude of the resultant force vectors can be modified in order to achieve the desired force action. This makes possible the required steerability and lateral mobility of the vibrating plate.

It is particularly advantageous if one of the imbalance masses is regarded as a reference imbalance mass, to which a separate phase adjustment device is not allocated, while a separate phase adjustment device is allocated to each of the other imbalance masses. In this way, the phase positions of these imbalance masses can be individually adjusted relative to the reference imbalance mass.

Because the reference imbalance mass does not require a separate phase adjustment device, it can be driven directly by a drive, thus keeping the mechanical outlay low.

In a particularly advantageous specific embodiment of the present invention, the axes of rotation of the imbalance masses are situated in a star-shaped [or: stelliform] arrangement relative to one another; here the angles between the axes of rotation can have the same angular size or different angular sizes.

Thus, at least four imbalance masses, or imbalance shafts bearing same, can be provided on the lower mass, whose phase positions relative to one another can be adjusted with the aid of at least three separate phase adjustment devices (the reference imbalance mass requiring no phase adjustment device).

It is particularly advantageous if the axes of rotation of the imbalance masses intersect essentially in one point. As explained below, this enables a particularly simple, purely mechanical drive, and is thus not absolutely necessary, even given a star-shaped arrangement of the axes of rotation of the imbalance masses.

Preferably, the axes of rotation of the imbalance masses are situated such that the force vectors produced by the imbalance masses during their rotation act in different planes. Only then is it also possible to achieve force components transverse to the longitudinal direction of the vibrating plate, in order to enable the vibrating plate to travel in the lateral direction as well. Here, the force vectors produced by at least some of the imbalance masses during their rotation should act in planes that are at angles to one another, rather than being parallel to one another.

Advantageously, those imbalance masses that are adjacent to one another with respect to their centers of gravity, i.e. that have relatively little distance between them in comparison with the other imbalance masses, are driven so as to rotate in opposite directions to one another. This opposite rotation of the imbalance masses, which usefully have the same mass, makes it possible to adjust the force vector resulting therefrom in a known manner.

Of course, the term "imbalance mass" is being used here in a generalized sense, and does not presuppose that the imbalance mass has to be formed by a single unified mass element. Rather, an imbalance mass can also be formed by a plurality of partial imbalance masses. However, it is presupposed that the partial imbalance masses on the same imbalance shaft rotate with the same rotational speed and phase position to one another. In contrast, different imbalance masses must be capable of being adjusted at least with respect to their phase position to one another, or must be capable of rotation in opposite directions.

In a particularly advantageous specific embodiment of the present invention, a plurality of individual exciters are provided, each of which has at least one of the imbalance masses and an imbalance shaft that bears the respective imbalance mass. The individual exciters are capable of being controlled individually with respect to the rotational speed and/or the phase position of the imbalance mass. In this way, small units can be provided in the form of the individual exciters, which in the simplest case have only a single imbalance shaft. The phase position, and if warranted also the rotational speed, of this imbalance shaft can be controlled individually, i.e. independently of the rotational speed or the phase position of other imbalance shafts. The overall vibration exciter device then has at least four of these individually controllable individual exciters, at least two of the individual exciters standing at an angle to the rest of the individual exciters.

The phase position of the imbalance shaft relates to its rotational position relative to the other imbalance shafts that work together with it.

Preferably, the upper mass has a drive for driving the vibration exciter device. The drive can for example supply the hydraulic drive energy for hydraulic motors, each of which drives one or more imbalance shafts on the lower mass.

Thus, for example each of the individual exciters can have a motor that rotationally drives the imbalance shaft.

In a particularly advantageous specific embodiment of the present invention, each of the individual exciters has a hydraulic motor that is capable of being driven by the drive situated on the upper mass, e.g. an internal combustion engine having a hydraulic pump. Alternatively, the motor can also be an electric motor.

With the just-described individual drivability of the individual imbalance shafts, in which the mutual relative position or phase position is not ensured by a positive coupling, it is useful to acquire the position of each imbalance shaft in at least one position, using a position sensor. In this way, on the one hand each of the imbalance shafts can be driven individually by the motor allocated to it, while on the other hand the actual position of the imbalance shaft is monitored constantly or at regular intervals via the position sensor. The position sensor should acquire the position of the imbalance shaft (or imbalance mass) in at least one position, i.e. should acquire the position once during a rotation of the imbalance shaft, from which the rotational speed of the imbalance shaft can be determined, and intermediate positions can also be interpolated. Of course, the position sensor can also be fashioned such that it permanently acquires the rotational position of the imbalance shaft, and thus its rotational speed. The precise recognition of the rotational position is important so that the phase position of the imbalance shaft can be derived therefrom.

With the aid of a central control device, the individual exciters can be coordinated so that each individual exciter achieves its individually pre-specified target rotational speed and/or target phase position. The central control device evaluates a desire on the part of the operator, and/or that is pre-specified by an operating or driving program, in order to achieve the desired behavior of the soil contact plate.

In another specific embodiment of the present invention, the imbalance shafts that bear the respective imbalance masses are coupled to one another by a gear mechanism, and are capable of being driven via a common drive. The gear mechanism enables a positive coupling, so that the relative phase position of the individual imbalance shafts or imbalance masses to one another is known at all times and can be maintained. The phase modification devices then need merely carry out the required modifications of the phase position relative to a defined, known initial phase position.

Advantageously, the imbalance shafts are situated in a star-shaped pattern around a central axis that is vertical relative to the soil contact plate, in such a way that the axes of rotation of the imbalance masses intersect the central axis. The gear mechanism has two central bevel gears that are situated on the central axis coaxially one over the other and that are oriented toward one another and are driven by the drive. Each of the imbalance shafts bearing an imbalance mass has allocated to it a drive bevel gear that meshes with one of the central bevel gears in order to drive the respective imbalance shaft. With the exception of one of the imbalance shafts, which bears the reference imbalance mass, the other imbalance shafts should be provided with a phase adjustment device in the flow of torque between the drive bevel gears and the respective imbalance mass, in order to enable modification of the rotational position of the imbalance mass, or of the imbalance shaft bearing it, relative to the other imbalance masses.

With the aid of the central bevel gears, a central drive is provided from which the imbalance shafts extending away from the central axis in a star-shaped pattern can obtain their drive energy. In this way, using a minimum number of gears a gear mechanism can be realized that distributes the drive energy from a single drive to the various imbalance shafts.

It is particularly advantageous if one of the drive bevel gears meshes with one of the central bevel gears, while the next (seen in the circumferential direction of the central bevel gears) drive bevel gear meshes with the other central bevel gear. The drive bevel gears should be situated between the central bevel gears. Due to the alternation of the sides at which the drive bevel gears mesh with the respectively allocated central bevel gear, it is possible to achieve a positively coupled rotational movement, in opposite directions, of the adjacent imbalance shafts.

In another specific embodiment, only one bevel gear is situated on the vertical central axis as a central bevel gear. The respectively desired change of direction from one shaft to the adjacent shaft is achieved by a reverse gear that is allocated to every second shaft. Planetary drives have proven particularly suitable for this. In such drives, the direction of rotation can be achieved by blocking the ring gear or the pinion cage that bears the planet gears. The desired phase adjustment is then possible in a known manner by rotating the blocked element (ring gear or pinion cage).

These and additional advantages and features of the present invention are explained in more detail below on the basis of examples, with the aid of the accompanying Figures.

DETAILED DESCRIPTION OF THE PREFERRED EMBODIMENT

Figure 1:
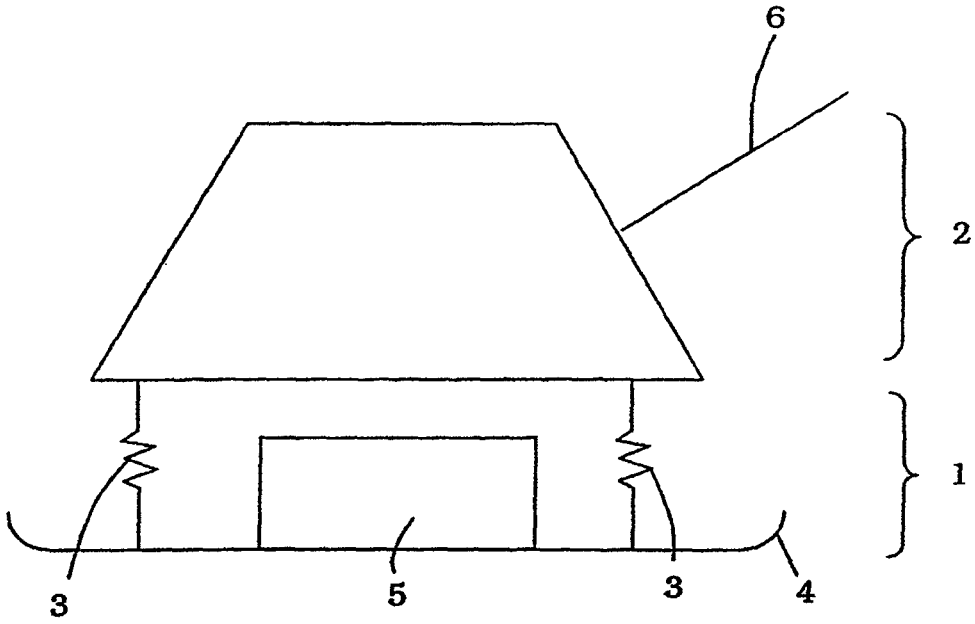
FIG. 1 shows a schematic side view of a vibrating plate according to the present invention.

FIG. 1 shows a schematic side view of a vibrating plate for soil compaction, having a lower mass 1 and an upper mass 2. Lower mass 1 is elastically coupled to upper mass 2 via a spring device 3, so as to be capable of motion. Spring device 3 can have e.g. rubber elements that are attached between lower mass 1 and upper mass 2.

Lower mass 1 has a soil contact plate 4 that stands in contact with the soil that is to be compacted and that bears a vibration exciter device 5. Vibration exciter device 5 produces vibrations that are introduced into soil contact plate 4 and that are used on the one hand for soil compaction, and on the other hand for steering and propulsion of the vibrating plate.

A drawbar 6 for operator guidance is attached to upper mass 2. Alternatively, or in addition, the vibrating plate can also be remotely controlled, so that no drawbar 6 is required.

In some circumstances, upper mass 2 also has as a component a drive, e.g. an internal combustion engine, that produces the energy required to drive vibration exciter device 5. The energy is transmitted mechanically (e.g. via a belt drive), hydraulically (using a hydraulic pump), or electrically (using a generator driven by the drive) to vibration exciter device 5, where imbalance shafts are driven rotationally in a known manner.

In the case of a mechanical transmission of the drive energy, it is sufficient to couple the drive side of the belt drive to at least one of the imbalance shafts that is connected via a gear mechanism to the other imbalance shafts. For the case (explained in more detail below on the basis of FIGS. 7 and 8) of an arrangement of a drive motor having a vertical driven shaft, it is possible to provide a compensating coupling between the vertical driven shaft coming from the motor and a drive shaft to which there is attached at least one central bevel gear (explained in more detail below). In this way, the central bevel gear can be driven directly by the motor.

In the case of a hydraulic transmission of energy, the hydraulic pump on the upper mass is used to produce a hydraulic pressure that sets the respective imbalance shafts into rotation via one or more hydromotors on the lower mass. In the case of an electrical transmission of energy, the electrical energy produced by the generator is transmitted to electric motors that set the imbalance shafts coupled to them into rotation.

Figure 2:
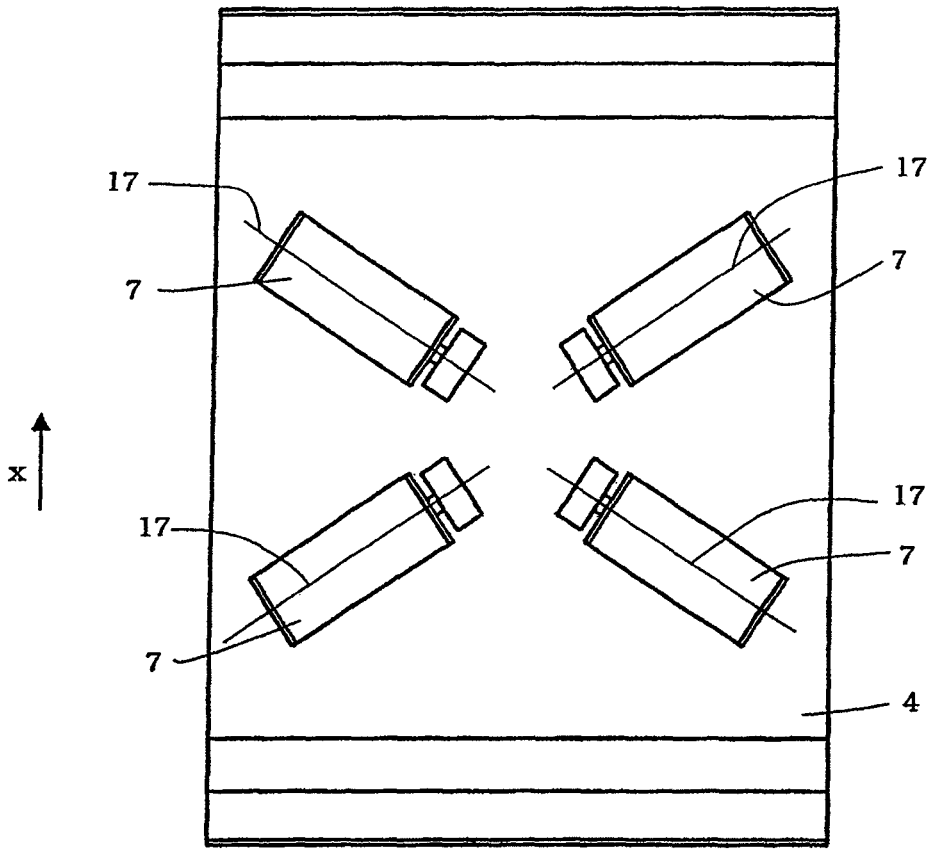
FIG. 2 shows a top view of a soil contact plate having a vibration exciter device according to a first specific embodiment of the present invention, in a vibrating plate according to the present invention.

FIG. 2 shows a schematic representation of a top view of soil contact plate 4, on which four individual exciters 7 are arranged at angles to one another, forming vibration exciter 5.

The two front (seen in the direction of travel X) individual exciters 7 are arranged at an obtuse angle to one another, while individual exciters 7 situated one after the other form acute angles to one another with regard to their axes of rotation 17.

Figure 3:
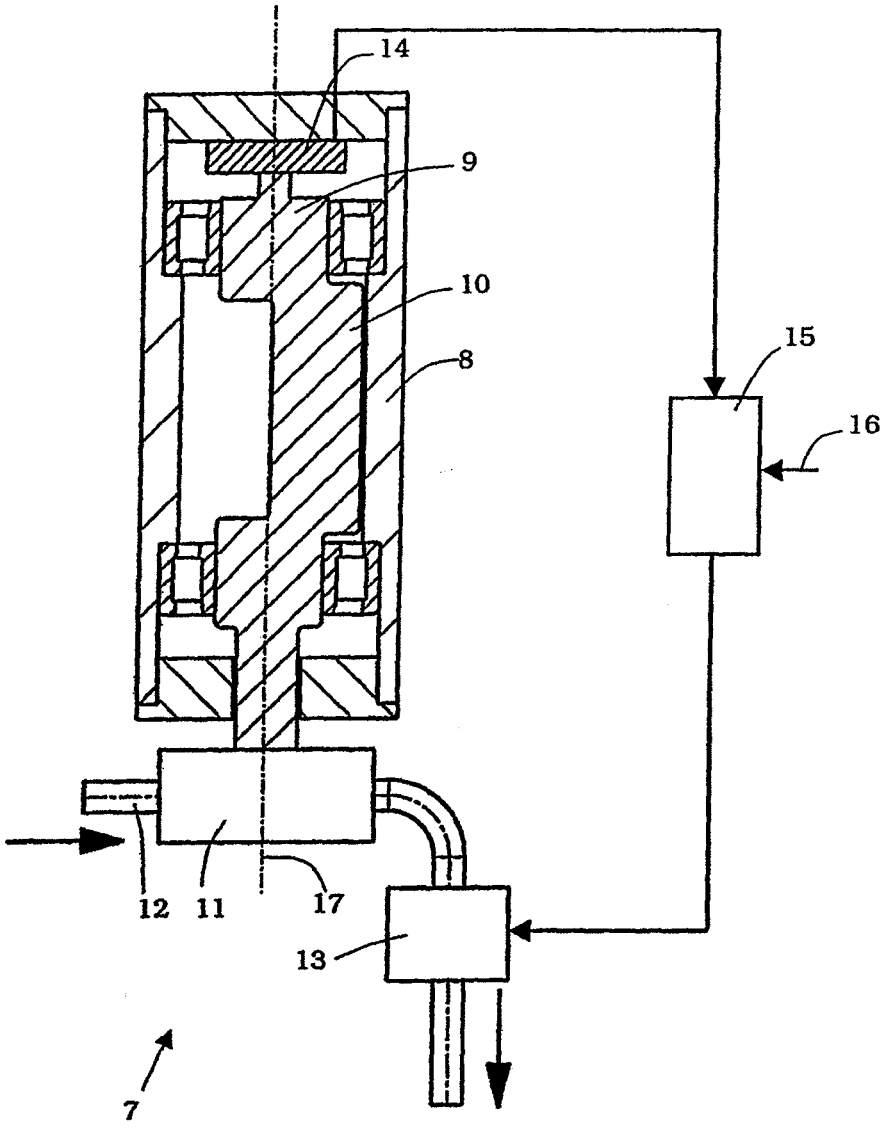
FIG. 3 shows a schematic section through an individual exciter used in the vibration exciter device of FIG. 2.

FIG. 3 shows a sectional view of the schematic design of an individual exciter 7.

An imbalance shaft 9 is rotationally mounted in a tube-shaped housing 8. Imbalance shaft 9 bears an imbalance mass 10.

Imbalance shaft 9 is rotationally driven by a hydraulic motor 11. Hydraulic fluid is supplied to hydraulic motor 11 via a hydraulic line 12 from a hydraulic supply (not shown). The hydraulic supply can be situated essentially on upper mass 2 in the vibrating plate. A component of the hydraulic supply is e.g. a diesel, gasoline, or electric unit that drives a hydraulic pump. The hydraulic pump produces a hydraulic pressure in a hydraulic fluid that can be stored in a hydraulic storage device. In addition, a hydraulic supply container must be provided for collecting and storing the hydraulic fluid. Due to the strong vibrations in lower mass 1, it is useful for most of the components of the hydraulic supply to be situated in upper mass 2, which is decoupled in terms of vibration from lower mass 1. In this way, it is then further required only to create a connection of the hydraulic supply to hydraulic motor 11, using hydraulic line 12.

Downstream from hydraulic motor 11 there is situated a hydraulic valve 13 that acts as an actuating element that controls the flow of hydraulic fluid to hydraulic motor 11, and thus influences the rotational speed of hydraulic motor 11. Of course, hydraulic valve 13 can also be situated upstream from hydraulic motor 11.

At an end of imbalance shaft 9 situated opposite hydraulic motor 11, there is situated a position sensor 14. Position sensor 14 (e.g. a device for acquiring the angle of rotation) is able to acquire the position of imbalance shaft 9 in at least one position. This can take place for example optically, magnetically, inductively, or capacitively. From the possibility of acquiring the position of imbalance shaft 9 at least one time during a rotation thereof, the rotational speed and the phase position of imbalance shaft 9 can be determined. In addition, it is straightforwardly possible to determine the position of imbalance shaft 9 with sufficient precision at any time using interpolation over time.

The position of imbalance shaft 9 is important because imbalance mass 10 carried by it produces a strong centrifugal force effect during rotation. The centrifugal force of imbalance mass 10 works together with the centrifugal forces of the other individual exciters 7 (FIG. 2) that belong to the vibration exciter device, thus producing an overall resultant force effect that determines the movement behavior of soil contact plate 4 charged by individual exciters 7. Soil contact plate 4 can move in the desired manner only when both the rotational speeds of imbalance shafts 9 and also their phase positions are precisely coordinated to one another.

The vibration exciter device according to the present invention has at least four of these individual exciters 7 that are situated on soil contact plate 4 in a suitable manner. Possible specific embodiments are described below.

Individual exciter 7 shown in FIG. 3 also has a controller 15 that evaluates the signal produced by position sensor 14 and determines at least the rotational speed and/or the position of imbalance mass 10 relative to a particular point in time (phase position).

In addition (as explained in more detail below), controller 15 receives a target value signal 16 that prespecifies the required target rotational speed or target phase position. Controller 15 controls hydraulic valve 13 in accordance with this signal in order to achieve the desired rotational speed and phase position of imbalance shaft 9 or imbalance mass 10, with the aid of hydraulic motor 11.

As shown in FIG. 2, according to the present invention at least four individual exciters 7, each having an imbalance shaft 9 and an imbalance mass 10 borne thereby, are to be arranged in a suitable manner. "In a suitable manner" here means that the axes of rotation 17 of at least two of the imbalance masses 10 or imbalance shafts 9 must stand at an angle to the axes of rotation 17 of the other imbalance masses 10. In the example shown in FIG. 2, it can be seen that two pairs of individual exciters 7 are situated such that the axes of rotation 17 of their respective imbalance masses 10 are situated parallel to one another and axially offset from one another. Imbalance shafts 9 or imbalance masses 10 that stand parallel to one another, or axially offset to one another or coaxially to one another, are not regarded as "standing at an angle" to one another. An angled arrangement presupposes that the axes of rotation 17 of two imbalance shafts 9 have an angle to one another other than 0° or 180°. This is the case for each of two pairs of individual exciters 7 in the specific embodiment according to FIG. 2. The arrangement shown in FIG. 2 is also regarded as "star-shaped," although the axes of rotation 17 of individual exciters 7 do not intersect in one point.

Controllers 15 of individual exciters 7 can be coupled to one another via a central control device (not shown). The central control device specifies the target value signals 16 for the separate individual exciters 7. Each controller 15 then ensures, for the individual exciter 7 allocated to it, that imbalance shaft 9 behaves in the desired manner. The target value signals 16 specified by the central control unit can be distinguished for each of the individual exciters 7. Essential distinguishing parameters include target rotational speed, target phase position, and target direction of rotation. The modification of the direction of rotation is optional, and requires additional constructive outlay in the realization of hydraulic motor 11 or of hydraulic valve 13. In the normal case, no modification of the direction of rotation will be required.

Alternatively, an individual exciter can also be provided that does not have an individually allocated controller 15. In this case, the signals from position sensors 14 of the various individual exciters 7 are sent to a central controller (not shown) that evaluates all the signals from all the individual exciters 7. The central controller then correspondingly carries out individual controlling of each hydraulic valve 13 in order to achieve the desired behavior of imbalance shaft 9 individually for each individual exciter 7.

The central control unit or central controller contains suitable operating or travel programs with which the travel and vibration behavior of the vibrating plate desired by the operator and specified via operating elements (remote control, operating lever, buttons) can be converted into control specifications for the individual exciters. If, for example, the operator wishes to carry out a transition from standing compaction of the vibrating plate to forward travel, the central control unit or central controller brings about an adjustment of the phase position in at least one of the individual exciters 7, causing a change in the direction of action of the resultant overall force.

For reliable normal operation, it is desirable for imbalance shafts 9 to rotate with exactly the same rotational speed, as far as possible. Because, however, the position of imbalance shafts 9 is also constantly monitored, deviations in the rotational speed can be corrected at any time in order to maintain the desired phase position between imbalance shafts 9. A progressive deviation of the rotational speed is thus excluded.

Figure 4:
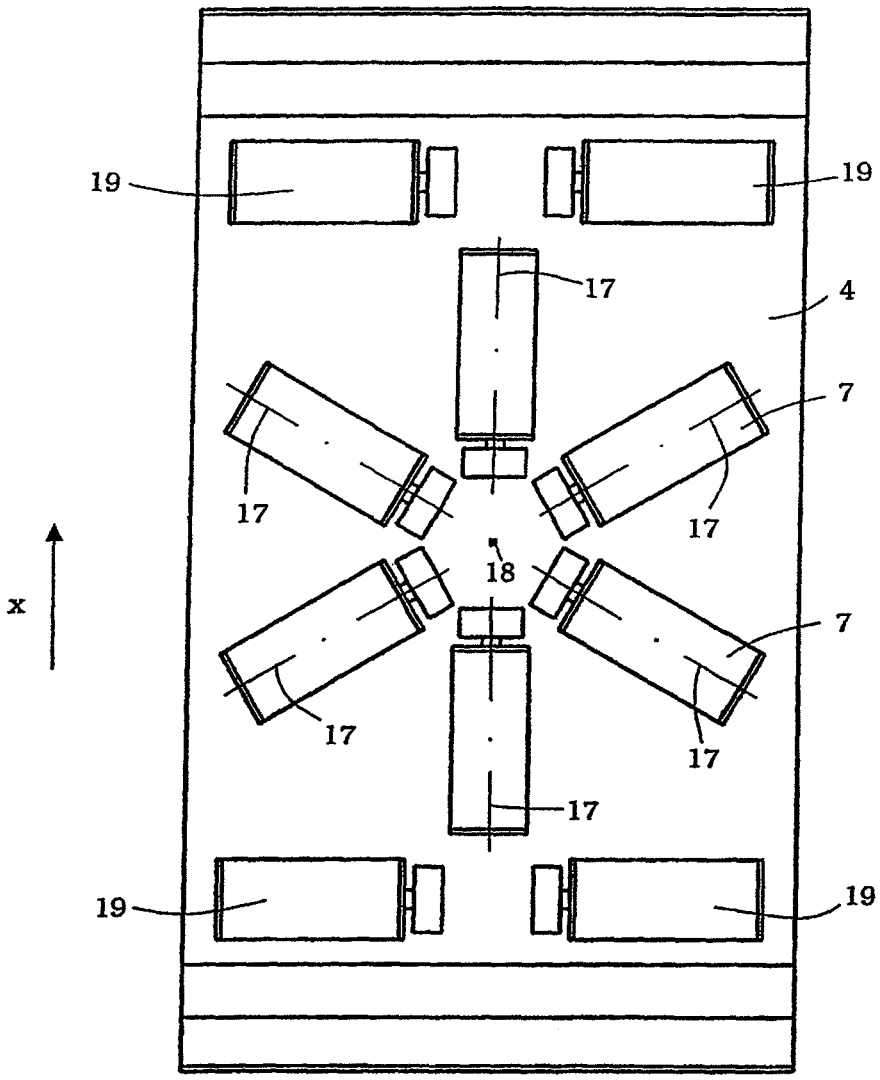
FIG. 4 shows a top view of a soil contact plate having a vibration exciter device according to a second specific embodiment of the present invention.

FIG. 4 shows another specific embodiment of the present invention, in the form of differently arranged individual exciters 7 on soil contact plate 4. In the center, six individual exciters 7 are arranged in a star-shaped pattern around a central axis (vertical axis) in such a way that the axes of rotation 17 of the individual imbalance shafts intersect in a point 18. In addition, additional individual exciters 19 are situated on soil contact plate 4, each producing, with their imbalance shafts, force actions in main travel direction X or in the opposite direction in order to support the travel motion of the vibrating plate. With the aid of individual exciters 7, arranged in a star-shaped pattern, it is possible, by producing a yaw moment about the vertical axis running through point 18, to steer the vibrating plate or to move it in a direction transverse or oblique to main direction of travel X. With corresponding controlling, it is thus possible to cause the vibrating plate to travel over the ground in any direction, with any orientation.

Figure 5:
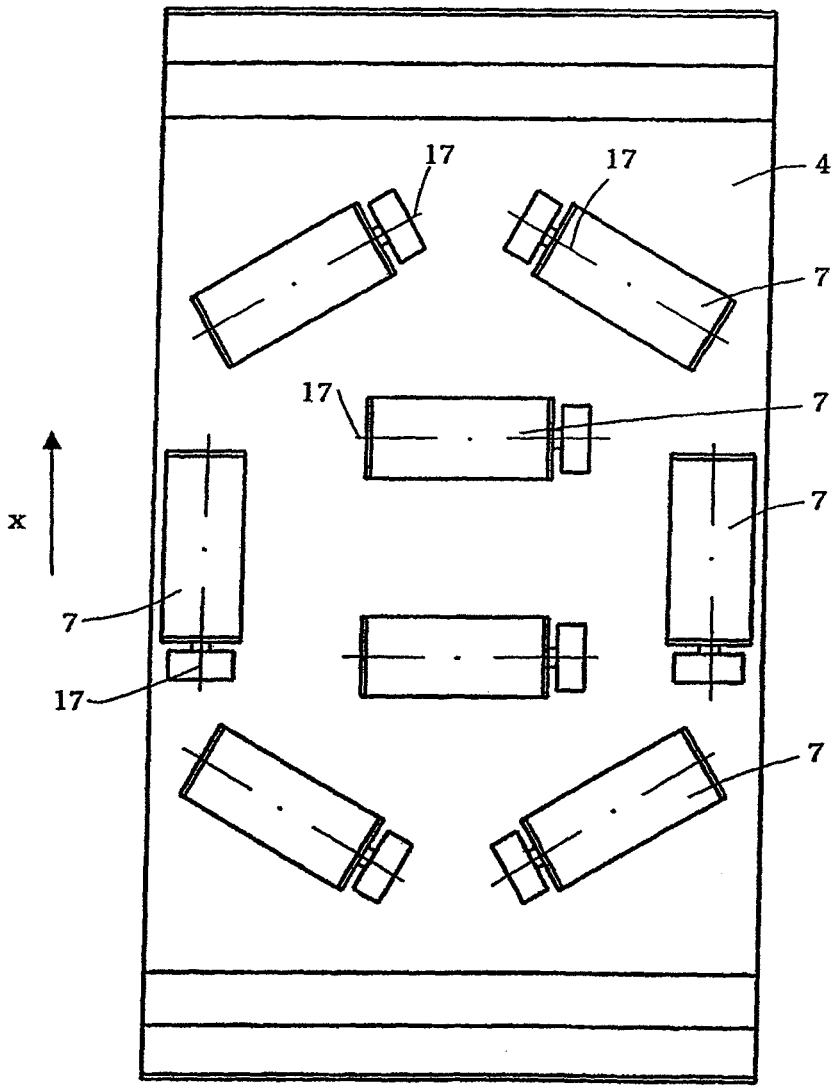
FIG. 5 shows a top view of a soil contact plate having a vibration exciter device according to a third specific embodiment of the present invention.

FIG. 5 shows another specific embodiment of the present invention, in which the individual exciters 7 are arranged on soil contact plate 4 in such a way that the axes of rotation 17 of the respective imbalance shafts are oriented parallel, perpendicular, or at an angle to main direction of travel X. As a result, it is possible to achieve travel characteristics similar to those of the vibrating plate according to FIG. 4. In the selection of the arrangement, almost any possibilities are available to someone skilled in the art, because, due to the hydraulically driven and individually controllable individual exciters 7, he is not bound to a mechanical coupling. Rather, he can situate individual exciters 7, each representing a complete unit, arbitrarily on soil contact plate 4. The controlling, in the form of the central control unit or central controller, is then to be programmed in a manner that takes into account the arrangement of the individual exciters 7 or 19.

Figure 6:
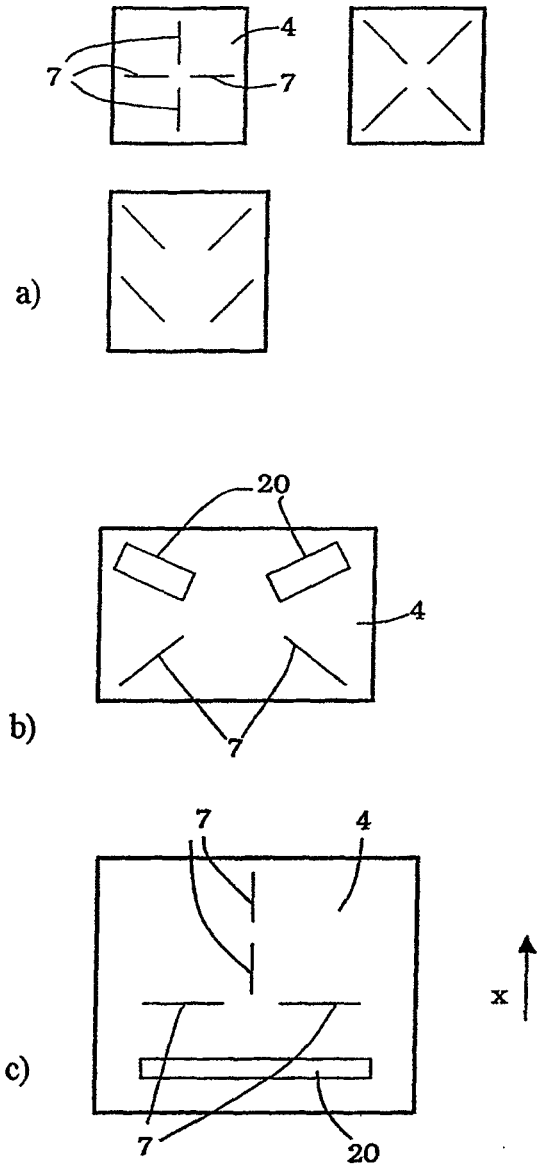
FIG. 6 shows examples of arrangements of imbalance shafts.

FIG. 6 shows, in a schematic top view, further possibilities for the arrangement of individual exciters 7 on soil contact plate 4. For simplification, individual exciters 7 are depicted only as lines that coincide with the axes of rotation of the imbalance shafts or imbalance masses.

In FIG. 6*a*, correspondingly, the imbalance shafts of some of the individual exciters 7 are arranged in parallel, axially offset, coaxially, and/or at an angle to one another.

In FIG. 6*b*, in addition to the "normal" individual exciters 7, reinforced individual exciters 20 are provided that preferably rotate with the same rotational speed and that have imbalance shafts having larger (in terms of mass) imbalance masses. Correspondingly, reinforced individual exciters 20 are symbolically shown not as lines but as elongated boxes.

Reinforced individual exciters 20 can be used predominantly to achieve a reinforced compaction effect or a more rapid forward and backward travel. Correspondingly, the normal individual exciters 7, or the exciters having smaller imbalance masses, are provided for the steering of the vibration plate. The imbalance shafts provided in reinforced individual exciters 20, having larger imbalance masses, can however be replaced by "normal" individual exciters 7 if, for example, a plurality of individual exciters 7 are provided one after the other and parallel to one another.

In FIG. 6*c*, five individual exciters are arranged on soil contact plate 4, i.e. four "normal" individual exciters 7 and a reinforced individual exciter 20 whose imbalance mass has twice the mass of an imbalance mass of an individual exciter 7. Individual exciters 7, 20, whose axes of rotation are perpendicular to main direction of travel X, are responsible for the propulsion or rearward travel of the vibrating plate, while the two exciters 7, whose axes of rotation extend in direction of travel X, bring about transverse travel or steering of the vibrating plate.

Figure 7:
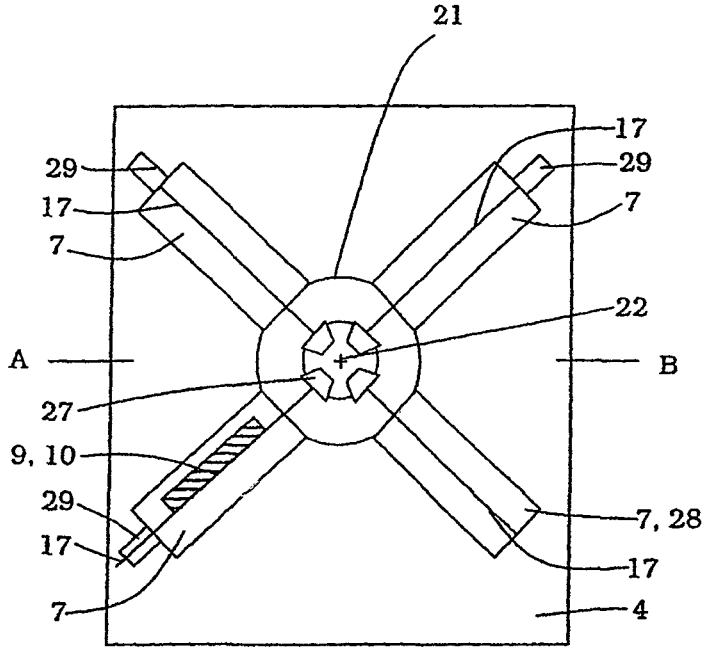
FIG. 7 shows a schematic top view of a soil contact plate in a fourth specific embodiment of the present invention.

Similar to FIG. 2, FIG. 7 shows a schematic top view of soil contact plate 4, on which four individual exciters are placed in a star-shaped arrangement. In contrast to the specific embodiment of FIG. 2, however, here the individual exciters 7 are not driven hydraulically, but rather are mechanically coupled to one another positively via a gear mechanism 21.

Figure 8:
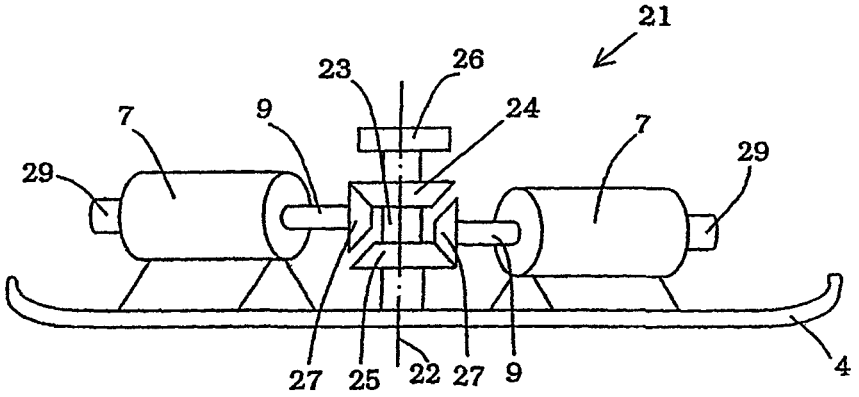
FIG. 8 shows a section through the top view of FIG. 7.

FIG. 8 shows a sectional representation of the vibrating plate of FIG. 7, along section line A-B.

In the center of the star-shaped arrangement of individual exciters 7 there extends a vertical central axis 22 about which a drive shaft 23 rotates. On drive shaft 23 there are attached two central bevel gears that are situated coaxially one over the other and are oriented toward each other, i.e. an upper central bevel gear 24 and a lower central bevel gear 25. Drive shaft 23, with the two central bevel gears 24, 25, is driven via a hydraulic motor 26 that is situated thereabove, to which hydraulic fluid under pressure is supplied by the drive situated on upper mass 2.

Instead of hydraulic motor 26, an internal combustion engine can also be provided whose preferably vertical driven shaft is coupled directly to drive shaft 23 via an elastic coupling. In this way, it is possible for the motor to drive shaft 23 with central bevel gears 24, 25 without the intermediate connection of a gear mechanism or hydraulic system.

Each imbalance shaft 9 of the individual drives 7 has, on its end facing housing 21, a drive bevel gear 27. The individual drives 7 can, with their imbalance shafts 9, be arranged on soil contact plate 4 so as to be alternately somewhat raised and somewhat lowered (offset in each case by the module of the toothing), so that the drive bevel gears mesh, in alternating fashion, with upper central bevel gear 24 and with lower bevel gear 25. This means that over the circumference of central axis 22, and thus along the circumference of central bevel gears 24, 25, in alternating fashion a drive bevel gear 27 meshes with upper central bevel gear 24, and the next following drive bevel gear 27 meshes with lower central bevel gear 25. In this way it is achieved that each pair of adjacent imbalance shafts 9, regarded along the circumference, rotate in opposite directions.

Due to the positive coupling of the individual imbalance shafts 9 via gear mechanism 21, a precise phase position relative to one another of the individual imbalance masses 10 is achieved at all times.

In order to enable controlling of the vibrating plates, it is necessary to adjust the phase positions of the individual imbalance masses relative to the phase positions of the other imbalance masses. For this purpose, three of the individual exciters 7 have a phase adjustment device. Fourth individual exciter 7 then does not require a phase adjustment device, so that its imbalance mass is designated reference imbalance mass 28. Reference imbalance mass 28 is coupled to hydraulic motor 26 directly and unalterably via gear mechanism 21 (positive rotational coupling). Accordingly, no modification is possible of the phase position of reference imbalance mass 28 to the motor shaft of hydraulic motor 26 or to drive shaft 23.

In contrast, the phase position of the imbalance masses 10 of the other individual exciters 7 can be modified relative to the phase position of drive shaft 23, and thus relative to reference imbalance mass 28, with the aid of the respective phase adjustment device. Each of the other individual exciters 7 thus has a phase adjustment device allocated to it individually.

As phase adjustment devices, e.g. turning sleeves, as known from the prior art (e.g. EP 0 358 744 A1), are suitable. However, other constructions of phase adjustment devices are also conceivable. The important thing is only that it be possible to adjust the phase position of the relevant imbalance shaft or imbalance mass individually, relative to the phase position of central drive shaft 23.

The phase adjustment device can have for example an actuator unit 29 via which a modification of the phase position of the imbalance mass inside the respective individual exciter 7 is carried out mechanically, electrically, or hydraulically. Here it is also possible to realize a phase adjustment device via intermediate connection of a planetary drive and targeted blocking or rotation of blocked elements (ring gear, pinion cage).

The coordination of the phase adjustment devices can be carried out manually by the operator, but can also be carried out by a central control device or central controller as described above.

The desired travel behavior of the vibrating plate is achieved through the interaction of the various imbalance masses 10 in the individual exciters 7.

The invention claimed is:

1. A vibrating plate for soil compaction, comprising:

an upper mass;

a lower mass that is elastically coupled to the upper mass and that has at least one soil contact plate; and a vibration exciter device that generates vibrations in the soil contact plate, the vibration exciter device having at least four imbalance masses, each capable of being driven rotationally about an axis of rotation, wherein the axes of rotation of at least two of the imbalance masses intersect each other at one of an acute angle and an obtuse angle, and wherein a phase adjustment device is allocated to each of at least some of the imbalance masses in order to adjust the phase position of the associated imbalance mass relative to the phase positions of the other imbalance masses.

2. The vibrating plate as recited in claim 1, wherein one of the imbalance masses is a reference imbalance mass, and wherein each of the other imbalance masses has allocated to it a separate phase adjustment device, such that the phase position of these imbalance masses is capable of being adjusted individually relative to the reference imbalance mass.

3. The vibrating plate as recited in claim 2, wherein a separate phase adjustment device is not allocated to the reference imbalance mass.

4. The vibrating plate as recited in claim 2, wherein the reference imbalance mass is capable of being driven directly by a drive without the intermediate connection of a phase adjustment device.

5. The vibrating plate as recited in claim 1, wherein the axes of rotation of the imbalance masses are arranged in a star-shaped pattern relative to one another.

6. The vibrating plate as recited in claim 1, wherein the axes of rotation of the imbalance masses stand at angles to one another having the same angular sizes.

7. The vibrating plate as recited in claim 1, wherein the axes of rotation of the imbalance masses stand at angles to one another having at least two different angular sizes.

8. The vibrating plate as recited in claim 1, wherein the axes of rotation of the imbalance masses intersect essentially in one point.

9. The vibrating plate as recited in claim 1, wherein the axes of rotation of the imbalance masses are arranged in such a way that the force vectors produced by the imbalance masses during their rotation act in different planes that are not parallel to one another.

10. The vibrating plate as recited in claim 1, wherein, with respect to their centers of gravity, each pair of adjacent imbalance masses is driven so as to rotate in opposite directions.

11. The vibrating plate as recited in claim 1, wherein individual exciters are provided that each have one of the imbalance masses and an imbalance shaft that bears the respective imbalance mass, and that are capable of being controlled individually with respect to at least one of the rotational speed and the phase position of the imbalance mass.

12. The vibrating plate as recited in claim 1, wherein the upper mass has a drive for driving the vibration exciter device.

13. The vibrating plate as recited in claim 11, wherein each of the individual exciters has a motor that drives the imbalance shaft rotationally.

14. The vibrating plate as recited in claim 13, wherein the motor is a hydraulic motor that is capable of being driven by the drive situated on the upper mass.

15. The vibrating plate as recited in claim 1, wherein the imbalance shafts bearing the respective imbalance masses are mechanically coupled by a gear mechanism and are capable of being driven via a common drive.

16. The vibrating plate as recited in claim 15, wherein the imbalance shafts are arranged in a star-shaped pattern around a central axis that is vertical relative to the soil contact plate, the gear mechanism has two central bevel gears that are situated coaxially one over the other on the central axis, are oriented toward one another, and are driven by the drive, and wherein each of the imbalance shafts has allocated to it a drive bevel gear that meshes with one of the central bevel gears in order to drive the respective imbalance shaft.

17. The vibrating plate as recited in claim 16, wherein one of the drive bevel gears meshes with one of the central bevel gears, and wherein the next drive bevel gear, seen in the circumferential direction of the central bevel gears, meshes with the other central bevel gear.

* * * * *